US006158635A

United States Patent [19]

Batts

[11] Patent Number: 6,158,635

[45] **Date of Patent: *Dec. 12, 2000**

[54] SHIP ON HANGER HAVING ANTI-DISLODGEMENT MEANS

[75] Inventor: John H. Batts, Grand Rapids, Mich.

[73] Assignee: Batts, Inc., Zeeland, Mich.

[ * ] Notice: This patent is subject to a terminal disclaimer.

[21] Appl. No.: 09/256,370

[22] Filed: Feb. 24, 1999

[51] Int. Cl.[7] ..... A47G 25/40

[52] U.S. Cl. ..... 223/96; 223/91

[58] Field of Search ..... 227/96, 95, 85, 227/92, 88, 91, 90, 93

[56] References Cited

U.S. PATENT DOCUMENTS

| | | | |
|---|---|---|---|
| D. 146,998 | 6/1947 | Townsend et al. | 223/96 |
| D. 185,716 | 7/1959 | Nalle, Jr. | 223/96 |
| D. 243,138 | 1/1977 | Coon | 223/96 |
| 1,081,058 | 12/1913 | Owens | 223/96 |
| 2,517,804 | 8/1950 | Shane | 223/96 |
| 2,939,588 | 6/1960 | Nalle, Jr. | 223/96 |
| 3,946,915 | 3/1976 | Crane | 223/96 |
| 4,009,807 | 3/1977 | Coon | 223/96 |
| 4,802,265 | 2/1989 | Stevenson | 223/96 |
| 5,212,854 | 5/1993 | Hollis | 223/96 |
| 5,400,932 | 3/1995 | Hollis | 223/96 |

*Primary Examiner*—Bibhu Mohanty
*Attorney, Agent, or Firm*—Baker & McKenzie

[57] ABSTRACT

A ship-on garment hanger having anti-dislodgement means at both ends of the hanger body consisting of an outwardly, downwardly curved extension of the hanger body which extends downwardly to a position below the top and upper end of the clamp assembly located at each end of the hanger body, the clamp assemblies being disposed beneath the hanger body and the curved extensions thereof.

10 Claims, 2 Drawing Sheets

Fig. 3.
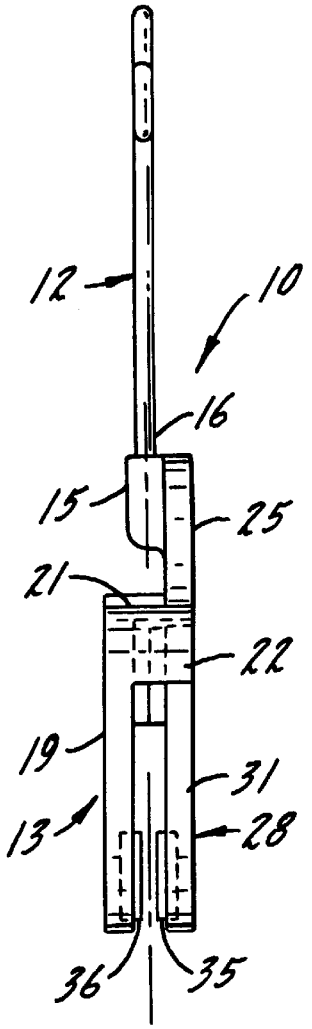
Fig. 4.
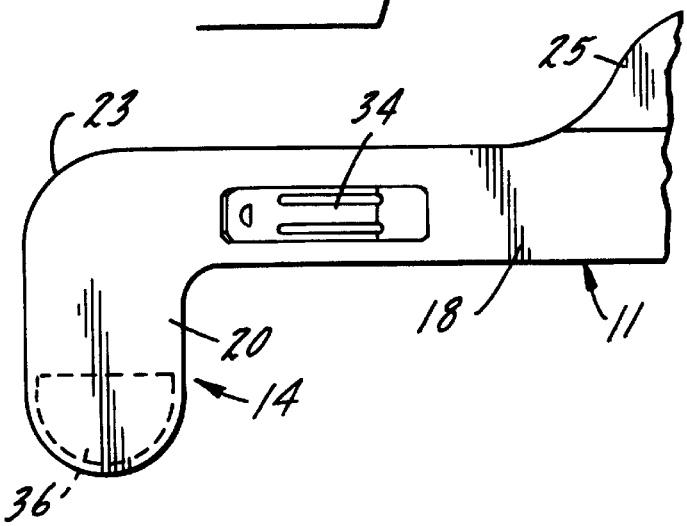
Fig. 6.
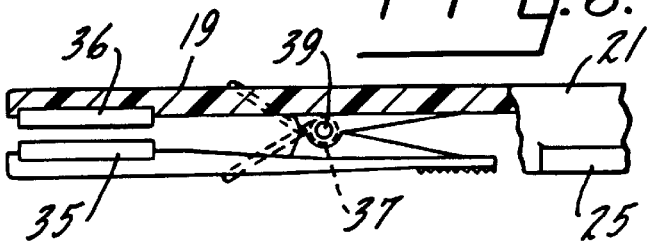
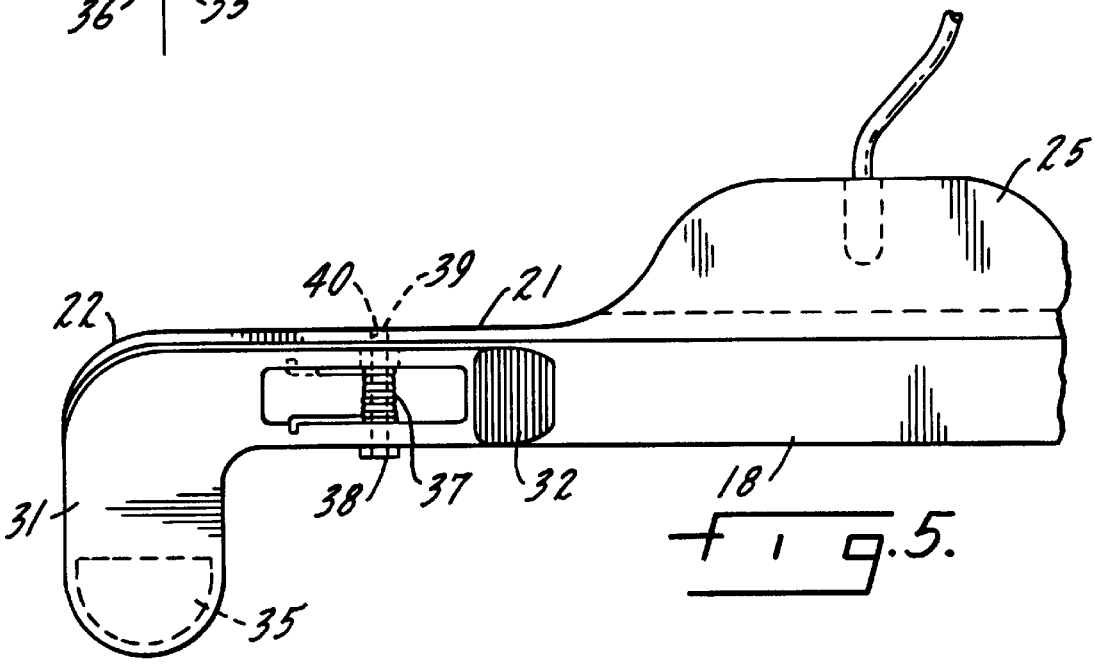
Fig. 5.

SHIP ON HANGER HAVING ANTI-DISLODGEMENT MEANS

This invention pertains generally to garment hangers and more specifically to a garment hanger adapted to be employed as a shipping hanger for garment-on-hanger use, said garment hanger further having means for (1) precluding dislodgement of a garment from its hanger by dislodgement forces encountered during transportation and push/pull forces arising during normal manipulation of garments by customers in retail outlets and (2) facilitating rack alignment operations at the conclusion of a selling day in retail outlets.

BACKGROUND OF THE INVENTION

A worldwide mode of doing business in the garment industry has evolved in recent years due to economic factors. For example, garments may be very inexpensively manufactured in less developed countries such as Sri Lanka, the garment hanger factory may be located in Taiwan or Hong Kong, and the garments may be destined for sale in the U.S. Thus it is quite common today for garments to be made in one country, the hangers on which the garments are to be displayed made in another country, and the garment displayed for sale in yet a third country.

At the retail sales level, there is an increasing trend to employ fewer and fewer selling personnel; indeed, the trend has almost reached a self-service mode of selling, though a few sales personnel will always be required for providing style information and fitting. The result however is that the ratio of number of garments to each sales person is increasing. While this ratio does not, in itself, present problems at the retail sale level (due to some extent at least, to lowered expectations of sales clerk assistance by retail customers), the greater number of garments in a retail store department presents logistics problems. For example, at the end of a selling day it is the duty of the sales personnel to straighten up the racks so that a neat and tidy appearance is presented to the eyes of the customers as they enter the department on the next selling day. The greater the number of garments on the racks per each sales person, the greater will be the time required by each sales person to straighten the racks, a fact which is not appreciated by sales personnel at the end of their shift. Part of the straightening process involves pulling a garment, say a size 36 men's slacks, which has been inadvertently placed in the size 38 section of the rack, and inserting it into the size 36 section. At the present time this task can be very time consuming and frustrating, especially when the rack space is limited as it always is for a period of time after a new season's inventory has been received. Specifically, the pulling out and pushing in motions of extracting a garment from one location on a rack and inserting the garment into another location on the rack can result in a garment on either the moved hanger or a racked hanger dropping its garment, or at least one side of the garment. This usually occurs when the clip of one hanger engages the clip of another hanger in a direction and with a force to cause one jaw of one of the interfering clips to open slightly, thereby releasing the gripping pressure on the garment and letting it drop under the impetus of its own weight. When such an event occurs the time to straighten a rack is increased, much to the annoyance of the sales personnel.

The problem of contact between two hangers with resultant spillage also occurs in the absence of a need to change the physical location of a garment along the axis of a suspending rack. Specifically, during the course of a selling day adjacent garments will be pulled off the racks, or tilted upwardly for viewing, by customers, following which little or no effort is made to make sure that the viewed garment is returned to a level position. Indeed, at the end of a selling day, some hangers will be level, some will be tipped upwardly at their outer end (i.e.: the end closest to the customer), and some will be tipped upwardly at their inner end. The result is a very untidy appearance. To return the garments to a neat, organized condition sales clerks prefer to either simply press downwardly on the upturned hangers or, at most, wiggle adjacent off-tilted hangers back and forth slightly so as to enable the garments to come back to a neutral position in which they hang straight down. Unfortunately these simple hand motions can also result in dropped garments due, to a considerable extent, to unlocking forces being exerted on one jaw of the two jaws which form the clamp at the end of each hanger. A basic cause of this problem is the fact that in most hangers in use today the upper portion of the clip which extends upwardly above the jaw is exposed in the sense that it projects into space outside the boundaries, that is, both the width and top dimensions of the hanger (using "top" in the sense of the upper surface of the elongated horizontal body of the hanger).

SUMMARY OF THE INVENTION

This invention is a garment hanger which overcomes all of the above described problems in a single hanger. Specifically, the hanger is so constructed that it will, (a) during transportation following assembly to a garment, (b) in the retail sales outlet, and (c) at all other times, grip a garment in such a fashion that the gripping pressure is not released and a garment dropped no matter how many shakes and bumps the hanger is subjected to during transportation or how quickly and carelessly garments are pulled from a rack and reinserted by customers, or pressed downwardly from above by the hands of a sales clerk passing over a series of hangers to bring the series into level alignment.

It is a further aim of this invention to accomplish all of the foregoing in a hanger which has a very low profile; that is, a hanger in which the clip at each end of the generally horizontally oriented hanger body does not project above the upper surface of the hanger body.

BRIEF DESCRIPTION OF THE DRAWING

The invention is illustrated more or less diagrammatically in the accompanying drawing wherein:

FIG. 3 is an end view with the garment omitted but showing the position of the jaws when holding a garment when viewed from the left side of FIG. 1;

FIG. 4 is a rear side view of the right end portion of the hanger as shown in FIG. 1;

FIG. 5 is a partial front side view of an alternative embodiment of the invention; and FIG. 6 is a partial top view with parts omitted and others broken away for clarity of the alternative embodiment of FIG. 5.

DESCRIPTION OF THE INVENTION

Figures 1, 2:
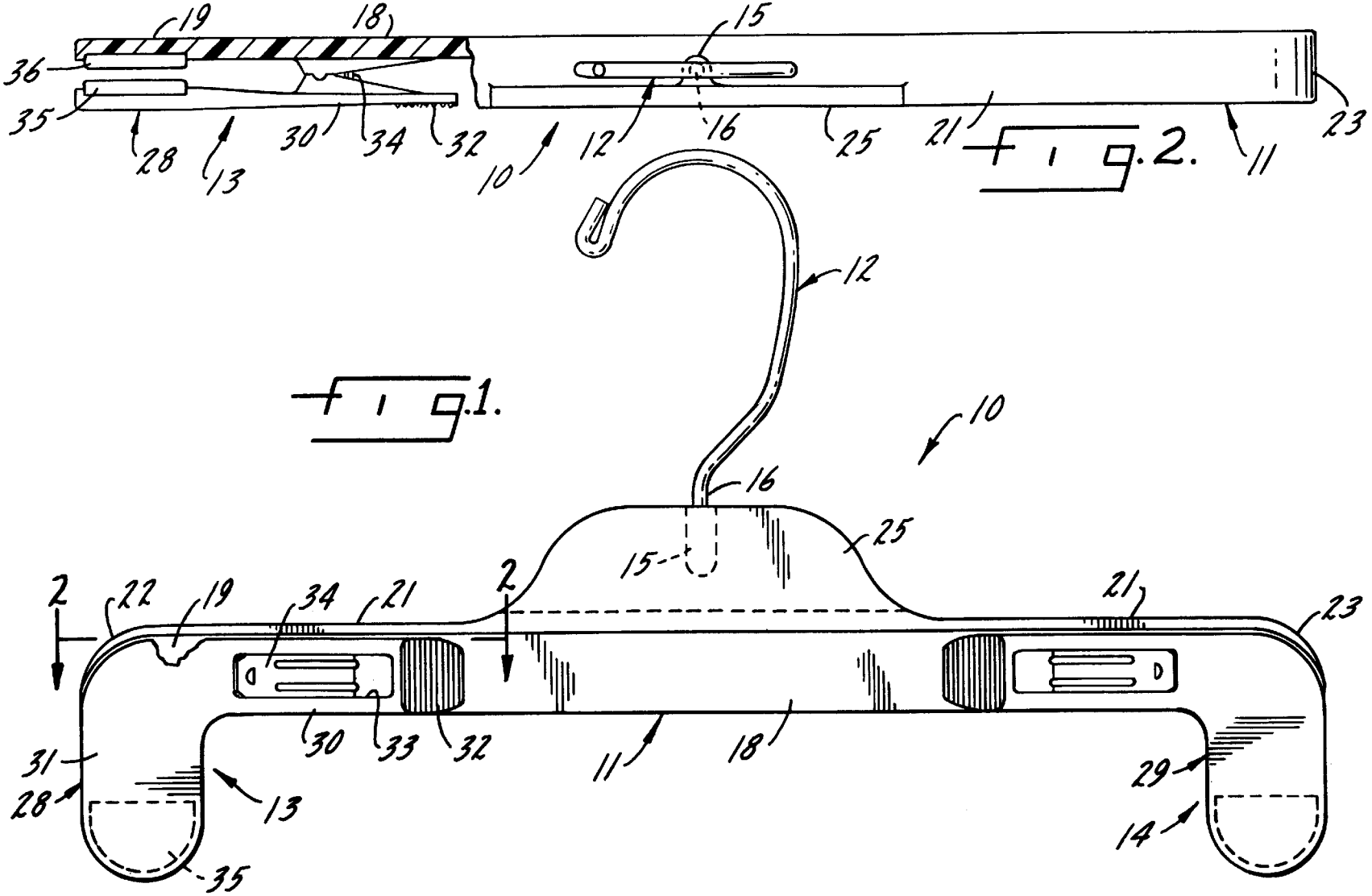
FIG. 1 is a view with a portion broken away for clarity showing the front side of the garment hanger of this invention in a normal, empty condition.
FIG. 2 is a top view with a portion broken away for clarity.

Like reference numerals will be used to refer to like or similar parts from Figure to Figure in the following description of the invention.

The garment hanger of this invention is particularly well suited for assembly to a garment at a remote garment manufacturing location and thereafter retention of the garment on the hanger until the hanger is separated from the garment at the retail sales outlet by a retail sales clerk or by the purchaser at his home. In view of this highly desirable characteristic the hanger will sometimes hereinafter be referred to as a "ship-on" hanger.

The ship-on hanger of this invention is indicated generally at 10 in FIGS. 1, 2 and 3. The hanger includes a horizontal body, indicated generally at 11, hook means, indicated generally at 12, and left and right clamp assemblies, indicated generally at 13 and 14 respectively. A hook boss is indicated at 15 to provide a receptacle for receiving the tail section 16 of the hook means 12. It should be understood that the hook means 12 can be either rigidly held in the hook socket in the hook boss 15 as by being insert molded therein, or be rotatable with respect thereto. Both systems are conventional in the art.

The body 11, in this instance, consists of an elongated, generally horizontally oriented vertical plate 18 which forms the rear wall of the hanger. Left and right end portions 19 and 20, respectively, extend downwardly at the ends of rear wall 18 to form the rear half of the clamp assemblies as viewed in FIG. 3. A top plate of the body 11 is indicated at 21. From FIG. 2 it will be noted that the top plate 21 overlies the clamp assemblies 13 and 14 and defines the maximum width of the hanger. The left end 22 of the top plate 21 curves outwardly and downwardly as best seen in FIGS. 1 and 3 and the right end 23 similarly curves outwardly and downwardly as best seen in FIGS. 1, 2 and 4. From FIGS. 1 and 3 it will be noted that the left end or skirt 22 extends downwardly a distance sufficient to protect the clamp assembly 13 against garment dislodgement forces directed against the clamp assembly 13 from the left as viewed in FIGS. 1 and 3. The right end or skirt 23 similarly extends downwardly a distance sufficient to protect the clamp assembly 14 against garment dislodgement forces directed against the clamp assembly 14 from the right as seen best in FIGS. 1 and 4.

A label plate 25 extends upwardly from the front side of body top plate as best seen in FIGS. 2 and 3. The hook boss 15 is located on the rear side of label plate 25 and, while extending rearwardly a distance sufficient to provide a socket for the bottom portion of hook 12, does not extend beyond the rear plane of rear wall 18 as best seen in FIG. 3.

Each of the front halves 28 and 29 of the left and right clamp assemblies 13 and 14, respectively, is formed in the shape of a right angle with a rounded junction where the two legs meet so that the bottom contour aligns with the contour of the left end portion 19 and right end portion 20 of body plate 18 as best seen in FIGS. 1 and 4. Since the front halves 28 and 29 are mirror images of one another, a description of one will be a description of both.

Left clamp assembly front half 28 consists of a horizontal leg 30 and a vertical leg 31. The bottom end of leg 31 is round and smooth. The right end of horizontal leg 30 has a knurled or otherwise roughened surface which forms a finger gripping pad 32 which is used by a clerk or customer to open and close the clamp assembly for removal or insertion of a garment. A cutaway 33 is formed in leg 30 for the purpose of receiving a conventional metal spinning clip 34 which, as is well known in the art, biases the front 31 and rear 19 portions of the left clamp assembly 13 toward a closed, garment gripping position. The front and rear halves of the clamp assembly pivot about, in this instance, pivot means which may be integrally molded into the front and rear halves 31 and 19 of the clamp assembly 13 as is well known in the art and shown in FIG. 2. The lower portions of the front and rear halves 31 and 19 of the clamp assembly 13, in this instance, carry garment gripping pads 35, 36 as best seen in FIGS. 2 and 3.

In the alternative embodiment of FIGS. 5 and 6 it will be seen that the conventional U-shaped clip 34 has been omitted and a coil spring 37 employed, the coil portion of the spring being slipped over pivot pin means 38 which is preferably formed as a separate component whose upper end 39 is received in a recessed hole 40 in top plate 21. One end of the coil spring is anchored in front half 31 and the other end is anchored in rear half 19 of the clamp assembly 13.

The end shields 22, 23 are particularly effective when hung garments are placed back onto a rack. Customers who have extracted a hung garment from a rack for observation are often quite careless in returning the garment which has just been observed back onto the rack. At the present time retail sales personnel are faced with the frequent task of picking up garments which have been completely or partially knocked off their hanger by careless and hurried handling by potential buyers. Since end shield 22 covers the upper ends of the movable leg 31 of the front half of the clamp assembly 13, there is no opportunity to snag a clamp on a racked garment and cause it to open and drop its garment.

It should also be noted that the illustrated and described construction provides maximum rack density which is highly desirable because the greater the number of garments which can be displayed per lineal foot of rack, the greater will be the sales of garments. By ensuring that the edges of the end shields 22, 23, and the outside surfaces of the clamp assemblies lie in the same plane when the hanger supports a garment, only the absolute minimum of rack length is required to display a garment.

It should also be noted that the horizontal orientation of that portion of each clamp assembly in which the biasing means is located enables a spring clip of a much longer dimension to be used than was heretofore customary. As a result creep of the clip during shipping of garments on hangers is eliminated and no garments are to be found lying in a crumpled heap at the bottom of the shipping container when it is opened at its destination.

Although a specific example, and a modification thereof, have been illustrated and described, it will at once be apparent to those skilled in the art that modifications to the basic inventive concept may be made within the spirit and scope of the invention. Hence the scope of the invention should only be limited only by the scope of the hereafter appended claims when interpreted in light of the relevant prior art, and not by the foregoing exemplary description.

I claim:

1. A ship-on garment hanger comprising:

a elongated hanger body with a clamp at each end thereof, at least one of said clamps being L-shaped and being comprised of a first jaw being a non-movable extension of said body and a second jaw pivotably movable relative to said first jaw, and a spring contacting each of said jaws and oriented to bring tips of said jaws together, a shielding member which projects outwardly and downwardly from the upper portion of the hanger body a distance sufficient to shield the said second jaw from contact with dislodgement forces.

2. The ship-on garment hanger of claim 1 further characterized in that the L-shaped clamp does not project above the hanger body.

3. The ship-on hanger of claim 2 further characterized in that each of the clamps at each end of said hanger body is an L-shaped clamp, and each of said L-shaped clamps is a pinch-type clamp and has a spring biasing the jaws of each of said L-shaped clamps into a closed position when not holding a garment, the shielding member of each clamp being located a vertically oriented outer edge of said first jaw of said clamp.

4. In a ship-on garment hanger, a generally horizontally disposed hanger body having a generally horizontally oriented mid-portion the end portions of the hanger body being oriented in a generally vertical, stationary position, said generally vertically oriented end positions each forming one half of a clamp assembly having two clamping members, the second of said two clamping members in each clamp assembly consisting of a movable generally L shaped member, one portion of which extends generally vertically downwardly in matching opposition to the generally vertically oriented end portion of the hanger body, the other portion of which extends generally horizontally and in general alignment with the generally horizontally oriented mid-portion of the hanger body, and means carried by each clamp assembly for protecting the outside edges and top of each of the clamp assemblies from contact with dislodgement forces.

5. The ship-on garment hanger of claim 4 further characterized in that the dislodgement protecting means are carried by the generally vertically oriented end portions of the hanger body.

6. The ship-on garment hanger of claim 5 further characterized in that the dislodgement protecting means is a shield which extends outwardly from the upper edge portion of the hanger body and then downwardly to a location below the top of the generally vertically downwardly extending portion of the second of the two clamping members in each clamping assembly.

7. The ship-on garment hanger of claim 6 further characterized in that each clamp assembly includes spring biasing means which bias the movable generally vertically oriented clamp member in each clamp assembly toward its associated stationary generally vertically oriented clamp member.

8. The ship-on garment hanger of claim 7 further characterized in that the spring biasing means which is arranged to press the movable clamping member toward the stationary clamping member is located in the generally horizontally oriented portion of the second, movable clamping member and the mid-portion of the hanger body.

9. The ship-on garment hanger of claim 8 further characterized in that the spring biasing means is generally U-shaped.

10. The ship-on garment hanger of claim 8 further characterized in that the spring biasing means is a coil spring, one each of which is anchored in the mid-portion of the hanger body and the other end of which is anchored in the second, movable clamping member.

* * * * *